US007302782B2

(12) United States Patent
Ausnit

(10) Patent No.: US 7,302,782 B2
(45) Date of Patent: Dec. 4, 2007

(54) METHOD AND APPARATUS FOR MAKING RECLOSABLE PACKAGES HAVING SLIDER-ACTUATED STRING ZIPPERS

(75) Inventor: Steven Ausnit, New York, NY (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 11/214,539

(22) Filed: Aug. 30, 2005

(65) Prior Publication Data

US 2005/0284106 A1 Dec. 29, 2005

Related U.S. Application Data

(62) Division of application No. 10/747,849, filed on Dec. 29, 2003, now Pat. No. 6,941,726.

(51) Int. Cl.
*B65B 61/18* (2006.01)

(52) U.S. Cl. ..... 53/412; 53/450; 53/133.4

(58) Field of Classification Search ..... 53/412, 53/450, 453, 133.4, 550, 562, 553; 493/213, 493/214, 394, 927
See application file for complete search history.

(56) References Cited

U.S. PATENT DOCUMENTS

| | | | | | |
|---|---|---|---|---|---|
| 3,347,298 | A * | 10/1967 | Ausnit et al. | ..... | 383/65 |
| 3,371,696 | A * | 3/1968 | Ausnit | ..... | 383/35 |
| 3,426,396 | A | 2/1969 | Laguerre | ..... | 24/201 |
| 3,565,147 | A * | 2/1971 | Ausnit | ..... | 383/63 |
| 5,105,603 | A * | 4/1992 | Natterer | ..... | 53/412 |
| 5,247,781 | A * | 9/1993 | Runge | ..... | 53/412 |
| 5,400,568 | A * | 3/1995 | Kanemitsu et al. | ..... | 53/412 |
| 5,884,452 | A * | 3/1999 | Bois | ..... | 53/412 |
| 5,983,466 | A | 11/1999 | Petkovsek | ..... | 24/400 |
| 6,088,887 | A | 7/2000 | Bois | ..... | 24/399 |
| 6,138,436 | A | 10/2000 | Malin et al. | ..... | 53/133.4 |
| 6,264,366 | B1 | 7/2001 | Custer | ..... | 383/5 |
| 6,286,999 | B1 | 9/2001 | Cappel et al. | ..... | 383/5 |
| 6,293,896 | B1 * | 9/2001 | Buchman | ..... | 493/213 |
| 6,477,820 | B1 * | 11/2002 | Dutra et al. | ..... | 53/412 |
| 6,477,821 | B1 | 11/2002 | Bois | ..... | 53/412 |
| 6,517,660 | B2 * | 2/2003 | Ausnit | ..... | 156/270 |
| 6,526,726 | B1 * | 3/2003 | Strand et al. | ..... | 53/412 |
| 6,804,935 | B2 * | 10/2004 | Schneider et al. | ..... | 53/412 |
| 6,810,641 | B2 * | 11/2004 | Ausnit | ..... | 53/412 |
| 2003/0089084 | A1 | 5/2003 | Ausnit | ..... | 53/412 |

* cited by examiner

*Primary Examiner*—Sameh H. Tawfik
(74) *Attorney, Agent, or Firm*—Ostrager Chong Flaherty & Broitman P.C.

(57) ABSTRACT

Methods and apparatus for making reclosable packages having slider-actuated string zippers. More specifically, the apparatus is a form-fill-seal machine having means for placing product on a web of packaging film; means for forming a receptacle having an interior volume and a mouth, with the product in the interior volume and a string zipper installed in the mouth, the web of packaging film forming at least one wall of the receptacle; a slider insertion device for inserting sliders on the string zipper; and means for sealing the receptacle so that ambient air cannot enter the interior volume. The form-fill-seal machine may further include either means for aligning an edge of the web with a flangeless zipper strip of the zipper strip before the web is joined to the flangeless zipper strip or means for trimming an edge of the web after a portion of the web proximal to the edge has been joined to a flangeless zipper strip of the string zipper.

10 Claims, 10 Drawing Sheets

METHOD AND APPARATUS FOR MAKING RECLOSABLE PACKAGES HAVING SLIDER-ACTUATED STRING ZIPPERS

RELATED PATENT APPLICATION

This application is a divisional of and claims priority from U.S. patent application Ser. No. 10/747,849 filed on Dec. 29, 2003 now U.S. Pat. No. 6,941,726.

BACKGROUND OF THE INVENTION

This invention generally relates to methods and apparatus for forming, filling and sealing reclosable packages. In particular, this invention relates to methods and apparatus for forming, filling and sealing reclosable packages having slider-actuated string zippers.

Reclosable bags are finding ever-growing acceptance as primary packaging, particularly as packaging for foodstuffs such as cereal, fresh fruit and vegetables, snacks and the like. Such bags provide the consumer with the ability to readily store, in a closed, if not sealed, package any unused portion of the packaged product even after the package is initially opened.

Reclosable bags comprise a receptacle having a mouth with a zipper for opening and closing. In recent years, many zippers have been designed to operate with a slider mounted thereon. As the slider is moved in an opening direction, the slider causes the zipper sections it passes over to open. Conversely, as the slider is moved in a closing direction, the slider causes the zipper sections it passes over to close. Typically, a zipper for a reclosable bag includes a pair of interlockable profiled closure strips that are joined at opposite ends of the bag mouth. The profiles of interlockable plastic zipper parts can take on various configurations, e.g. interlocking rib and groove elements having so-called male and female profiles, interlocking alternating hook-shaped closure elements, etc. Reclosable bags having slider-operated zippers are generally more desirable to consumers than bags having zippers without sliders because the slider eliminates the need for the consumer to align the interlockable zipper profiles before causing those profiles to engage.

In one type of slider-operated zipper assembly, the slider straddles the zipper and has a separating finger or plow in the middle or at one end that is inserted between the zipper profiles to force them apart as the slider is moved along the zipper in an opening direction. The other end of the slider is sufficiently narrow to force the zipper profiles into engagement and close the zipper when the slider is moved along the zipper in a closing direction.

In the past, many interlocking closure strips were formed integrally with the bag making film, for example, by extruding the bag making film with the closure strips formed on the film. Such constructions, however, were limited by the conditions required to extrude both the film and zipper together. To avoid such limitations, many bag designs entail separate extrusion of the closure strips, which are subsequently joined to the bag making film, for example, by conduction heat sealing. These separate closure strips typically have flanges extending therefrom in such a way that the flanges can be joined to bag making film in order to attach the closure strips to the film. Until recently, slider-operated, separately extruded zippers used flange-type constructions.

An alternative zipper design is the so-called flangeless or string zipper, which has substantially no flange portion above or below the interlockable closure profiles. In the case of a string zipper, the bag making film is joined to the backs of the bases of the closure strips. String zippers can be produced at much greater speeds, allow much greater footage to be wound on a spool, thereby requiring less set-up time, and use less material than flanged zippers, enabling a substantial reduction in the cost of manufacture and processing.

Recently, slider-operated, separately extruded zippers that do not use flange-type constructions have been disclosed. U.S. patent application Ser. No. 10/367,450, entitled "Reclosable Packaging Having Slider-Operated String Zipper", discloses a reclosable bag in which respective marginal portions of the bag film are sealed to the backs of respective flangeless zipper strips. The resulting string zipper is actuated by means of a straddling-type slider that separates the zipper strips during opening. U.S. patent application Ser. No. 10/436,433, entitled "Method and Apparatus for Inserting Sliders During Automated Manufacture of Reclosable Bags", discloses methods and apparatus for manufacturing reclosable bags having slider-actuated string zippers, including methods and apparatus for inserting sliders with plows on string zippers.

There is a need for form-fill-seal (FFS) machines designed to package products in reclosable packages having slider-actuated string zippers. Such machines should include devices for inserting sliders. The sliders may have plows or not.

BRIEF DESCRIPTION OF THE INVENTION

The present invention is directed to horizontal form-fill-seal (HFFS) machines for making reclosable packages having slider-actuated string zippers and to related methods of manufacture.

One aspect of the invention is a form-fill-seal machine comprising: means for placing product on a first web of packaging film; means for forming a receptacle having an interior volume and a mouth, with the product in the interior volume and a string zipper installed in the mouth, the first web of packaging film forming at least one wall of the receptacle; a slider insertion device for inserting sliders on the string zipper; and means for sealing the receptacle so that ambient air cannot enter the interior volume.

Another aspect of the invention is a method of making reclosable packages, comprising the following steps: placing product on a first web of packaging film; forming a receptacle having an interior volume and a mouth, with the product in the interior volume and a string zipper installed in the mouth, the first web of packaging film forming at least one wall of the receptacle; inserting sliders on the string zipper, and sealing the receptacle so that ambient air cannot enter the interior volume.

A further aspect of the invention is a method of making reclosable packages, comprising the following steps: (a) providing a continuous elongated web of packaging film having first and second edges that are generally mutually parallel and extend generally horizontally; (b) placing products to be packaged at spaced intervals along one half of the web; (c) folding the web along a generally central line to form a first folded side and a second folded side interconnected by a folded section, the products being located between the first and second folded sides; (d) joining a back of a continuous length of a first flangeless zipper strip to the web along a first longitudinal zone proximal to the first edge of the web; (e) joining a back of a continuous length of a second flangeless zipper strip to the web along a second longitudinal zone proximal to the second edge of the web; (f) aligning the first flangeless zipper strip with the second flangeless zipper strip; (g) inserting sliders at spaced intervals along the aligned first and second flangeless zipper strips, the first and second longitudinal zones of the web passing between respective side walls of the slider and the respective backs of the first and second flangeless zipper strips; (h) sealing the folded web crosswise at regular intervals located between the products; and (i) severing individual packages by cutting the folded web and the first and second flangeless zipper strips at regular intervals, wherein the cut lines generally intersect the respective crosswise seals formed in step (h).

Yet another aspect of the invention is a method of making reclosable packages, comprising the following steps: (a) interlocking a continuous length of a first flangeless zipper strip to a continuous length of a second flangeless zipper strip, thereby forming a continuous length of zipper; (b) providing a continuous elongated bottom web of packaging film having first and second edges that are generally mutually parallel and extend generally horizontally; (c) placing products to be packaged at spaced intervals on and along the bottom web; (d) placing the continuous length of zipper on and along a first longitudinal zone proximal to the first edge of the bottom web; (e) joining a back of the continuous length of the first flangeless zipper strip to the bottom web along the first longitudinal zone; (f) laying a continuous elongated top web of packaging film over a portion of the bottom web having the products and the zipper thereon, the top web having first and second edges that are generally mutually parallel and extend generally horizontally, the first edge of the top web being near the first edge of the bottom web; (g) joining a back of the continuous length of a second flangeless zipper strip to the top web along a second longitudinal zone proximal to the first edge of the top web; (h) inserting sliders at spaced intervals along the zipper, the first longitudinal zone of the bottom web being disposed between one side wall of the slider and the back of the first flangeless zipper strip, and the second longitudinal zone of the top web being disposed between another side wall of the slider and the back of the second flangeless zipper strip; (i) sealing the folded web crosswise at regular intervals located between the products; and (j) severing individual packages by cutting the folded web and the first and second flangeless zipper strips at regular intervals, wherein the cut lines generally intersect the respective crosswise seals formed in step (i).

A further aspect of the invention is a horizontal form-fill-seal machine comprising: means for providing a continuous elongated web of packaging film having first and second edges that are generally mutually parallel and extend generally horizontally; means for placing products to be packaged at spaced intervals along one half of the web; means for folding the web along a generally central line to form a first folded side and a second folded side interconnected by a folded section, the products being located between the first and second folded sides; means for joining a back of a continuous length of a first flangeless zipper strip to the web along a first longitudinal zone proximal to the first edge of the web; means for joining a back of a continuous length of a second flangeless zipper strip to the web along a second longitudinal zone proximal to the second edge of the web; means for aligning the first flangeless zipper strip with the second flangeless zipper strip; means for inserting sliders at spaced intervals along the aligned first and second flangeless zipper strips, the first and second longitudinal zones of the web passing between respective side walls of the slider and the respective backs of the first and second flangeless zipper strips; means for sealing the folded web crosswise at regular intervals located between the products; and means for severing individual packages by cutting the folded web and the first and second flangeless zipper strips at regular intervals, wherein the cut lines generally intersect the respective crosswise seals formed by the sealing means.

Yet another aspect of the invention is a horizontal form-fill-seal machine comprising: means for interlocking a continuous length of a first flangeless zipper strip to a continuous length of a second flangeless zipper strip, thereby forming a continuous length of zipper; means for providing a continuous elongated bottom web of packaging film having first and second edges that are generally mutually parallel and extend generally horizontally; means for placing products to be packaged at spaced intervals on and along the bottom web; means for placing the continuous length of zipper on and along a first longitudinal zone proximal to the first edge of the bottom web; means for joining a back of the continuous length of the first flangeless zipper strip to the bottom web along the first longitudinal zone; means for laying a continuous elongated top web of packaging film over a portion of the bottom web having the products and the zipper thereon, the top web having first and second edges that are generally mutually parallel and extend generally horizontally, the first edge of the top web being near the first edge of the bottom web; means for joining a back of the continuous length of a second flangeless zipper strip to the top web along a second longitudinal zone proximal to the first edge of the top web; means for inserting sliders at spaced intervals along the zipper, the first longitudinal zone of the bottom web being disposed between one side wall of the slider and the back of the first flangeless zipper strip, and the second longitudinal zone of the top web being disposed between another side wall of the slider and the back of the second flangeless zipper strip; means for sealing the folded web crosswise at regular intervals located between the products; and means for severing individual packages by cutting the folded web and the first and second flangeless zipper strips at regular intervals, wherein the cut lines generally intersect the respective crosswise seals formed by the sealing means.

Other aspects of the invention are disclosed and claimed below.

BRIEF DESCRIPTION OF THE DRAWINGS

Reference will now be made to the drawings in which similar elements in different drawings bear the same reference numerals.

DETAILED DESCRIPTION OF THE INVENTION

The invention is directed to FFS machines capable of making reclosable packages having slider-actuated string zippers. The sliders may have plows (i.e., separating fingers) or not. For the sake of illustration, a reclosable package having a string zipper and a slider with plow will now be described with reference to FIG. 1. The FFS machines encompassed by the present invention includes machines to make packages comprising string zippers and sliders different in construction from that depicted in FIG. 1.

Figure 1:
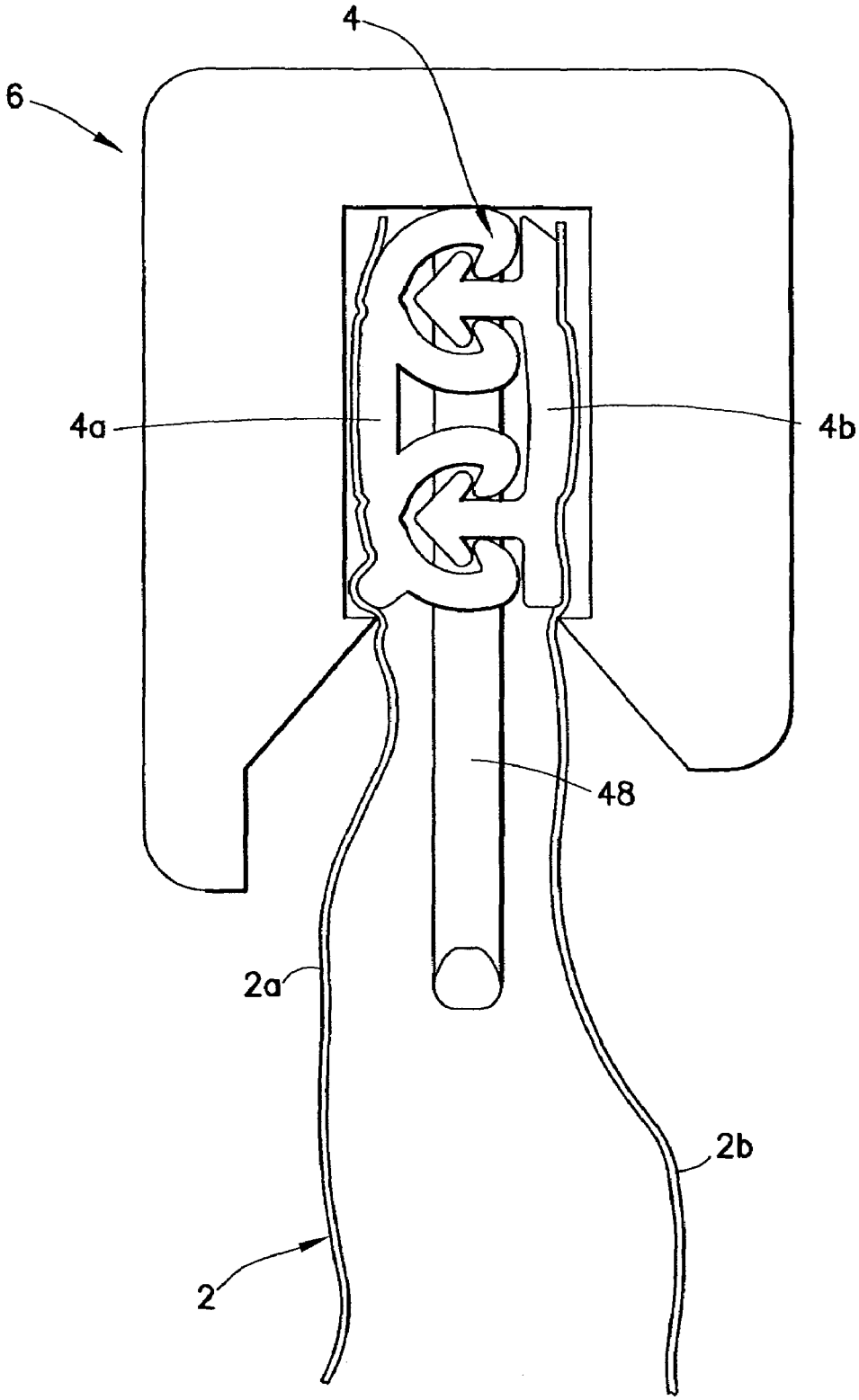
FIG. 1 is a drawing showing a partially sectioned view of a slider-string zipper assembly incorporated in a reclosable package. The zipper and receptacle are shown only in a section plane in front of the closing end of the slider. The portions of the zipper and receptacle disposed behind the section plane have not been shown to avoid cluttering the drawing.

A reclosable package or bag comprising a receptacle 2 and a flexible plastic string zipper 4, operated by manipulation of a slider 6, is partially shown in FIG. 1, adapted from U.S. patent application Ser. No. 10/367,450. The receptacle 2 comprises mutually opposing front and rear walls 2*a* and 2*b* that are joined together (e.g., by conventional conductive heat sealing) at opposite side edges of the receptacle to form respective seams (not shown in FIG. 1). The opposing bottoms of the walls 2*a* and 2*b* may also be joined, for example, by means of a heat seal. Typically, however, the bottom of the package is formed by a fold (not shown) in the original packaging film.

The walls 2*a* and 2*b* of the receptacle 2 may be made from any suitable film material, including thermoplastic film materials such as low-density polyethylene, substantially linear copolymers of ethylene and a C3-C8 alpha-olefin, polypropylene, polyvinylidene chloride, mixtures of two or more of these polymers, or mixtures of one of these polymers with another thermoplastic polymer. The person skilled in the art will recognize that this list of suitable materials is not exhaustive. The thickness of the film is preferably 2 mils or less.

At its top end, the receptacle 2 has an openable mouth, on the inside of which is an extruded plastic string zipper 4. The string zipper 4 comprises a pair of interlockable zipper strips 4*a* and 4*b*. Although FIG. 1 shows a rib and groove arrangement, the profiles of the zipper strips may take any form. For example, the string zipper may comprise interlocking rib and groove elements (as shown in FIG. 1) or alternating hook-shaped closure elements. The preferred zipper material is polyethylene or polypropylene. The top edges of the front and rear walls 2*a* and 2*b* (see FIG. 1) are respectively sealed to the backs of the zipper strips 4*a* and 4*b* by a conventional conduction heat sealing technique.

The string zipper is operated by moving the slider 6 along the zipper strips. The bag partially shown in FIG. 1 further comprises end stops (not shown in FIG. 1) for preventing the slider from sliding off the ends of the zipper when the slider reaches the zipper closed or fully opened position. Such end stops perform dual functions, serving as stops to prevent the slider from going off the end of the zipper and also holding the two zipper profiles together to prevent the bag from opening in response to stresses applied to the profiles through normal use of the bag. In accordance with one embodiment of the invention, the end stops comprise stomped areas on the zipper parts themselves. The stomped end stops may comprise sections of the zipper parts that have been fused together and flattened at the ends of the zipper. During deformation, thermoplastic zipper material flows upward such that the end stops are raised in height above the peak of the undeformed zipper on which the slider rides. Such stomping can be carried out using ultrasonic welding equipment of the type disclosed in U.S. patent application Ser. No. 10/113,489, entitled "Method and Apparatus for Ultrasonically Stomping Slider End Stops on Zipper".

Zipper strip 4*b* comprises a base and two generally arrow-shaped rib-like male closure elements or members projecting from the base. Zipper strip 4*a* comprises two pairs of hook-shaped gripper jaws connected by a sealing bridge. The pairs of gripper jaws form respective complementary female profiles for receiving the male profiles of zipper strip 4*b*. Alternatively, one zipper part could have one male profile and one female profile, while the other zipper part has one female profile and one male profile, or the respective zipper parts could each have more than two male or female profiles. The sealing bridge of zipper strip 4*a* and the base of zipper strip 4*b* are resiliently flexible self-supporting structures having a thickness greater than the thickness of the bag film. The male closure elements are integrally formed with the base, while the female closure elements are integrally formed with the sealing bridge.

The upper margins of the walls 2*a* and 2*b* of the bag are joined to the backs of the sealing bridge and the base respectively. The upper margins of the bag film may have short free ends, as seen in FIG. 1, provided that the free ends are not so long as to interfere with travel of the slider along the zipper or become entangled with the zipper profiles.

The slider 10 comprises a top wall 42 and a pair of side walls 44, 46 that form a tunnel for passage of the string zipper 4 therethrough. The width of the tunnel is substantially constant along the section that is divided by the plow 48 and then narrows from a point proximal to the end of the plow to the closing window at one end face of the slider. The closing end of the slider is seen in FIG. 1. The upper margins of the bag walls 2*a* and 2*b*, which are joined to the backs of the zipper strips 4*a* and 4*b*, are disposed between the respective zipper strips 4*a*, 4*b* and the respective side walls 44, 46 of the slider. Also, the slider shown in FIG. 1 has one leg (i.e., side wall 46) longer than the other, to wit, an extension 58 of side wall 46 projects to an elevation lower than the bottom edge of the opposing side wall 44. This design facilitates proper orientation of the slider during automated feeding to a slider insertion device, as explained below.

The plow or divider 48 depends downward from a central portion of the top wall 42 to an elevation below the lowermost portions of each sidewall 44, 46. The plow 48 is disposed between opposing sections of the zipper strips that pass through the tunnel. The tip of the plow 48 is truncated and has rounded edges and flattened corners at opposing ends for facilitating insertion of the plow between the zipper profiles without snagging during automated slider insertion. As the slider is moved in the opening direction (i.e., with the closing end leading), the plow 48 pries the impinging sections of zipper strips 4*a* and 4*b* apart.

In the embodiment depicted in FIG. 1, the slider 10 further comprises a retaining projection or ledge 54 that projects inward from the side wall 44 and a retaining projection or ledge 56 that projects inward from the side wall 46. The ledges 54 and 56 project toward each other, forming respective latches for latching the slider onto the zipper, thereby increasing slider pull-off resistance. The ledges 54 and 56 further comprise respective inclined bottom surfaces 50 and 52 that extend downward and outward from the respective inner edges of the generally horizontal surfaces. The inclined surfaces 50 and 52 are each substantially planar and serve to guide the respective zipper strips 4*a* and 4*b* into the slider tunnel during automated insertion of the slider onto an open section of the zipper. The sliders are typically inserted at spaced intervals onto a string zipper with joined bag film that is advanced intermittently past automated slider insertion device.

Systems for transporting sliders to a slider insertion device are disclosed in U.S. patent application Ser. No. 10/106,687 filed on Mar. 25, 2002 and entitled "System for Transporting Sliders for Zipper Bags". That application discloses feeding sliders into a slider insertion device by means of a feeder tube that only accepts correctly oriented sliders having an asymmetric profile, i.e., one leg of the slider is longer than the other leg. Similarly, the slider shown in FIG. 1 has one leg (i.e., side wall 46) longer than the other, to wit, an extension 58 of side wall 46 projects to an elevation lower than the bottom edge of the opposing side wall 44. The sliders are launched into the feeder tube by a sender apparatus that is controlled by a programmable controller based on feedback received by the controller from various sensors that detect the presence or absence of sliders at particular locations in the slider transport system. The sliders are pneumatically transported in predetermined quantities from a supply of sliders, e.g., a vibratory hopper, to a loading rack built into or mounted over the slider insertion device.

The slider may be made in multiple parts and welded together or the parts may be constructed to be snapped together. The slider may also be of one-piece construction. The slider can be made using any desired method, such as injection molding. The slider can be molded from any suitable plastic, such as nylon, polypropylene, polystyrene, acetal, polyketone, polybutylene terephthalate, high-density polyethylene, polycarbonate, or ABS.

Figure 2:
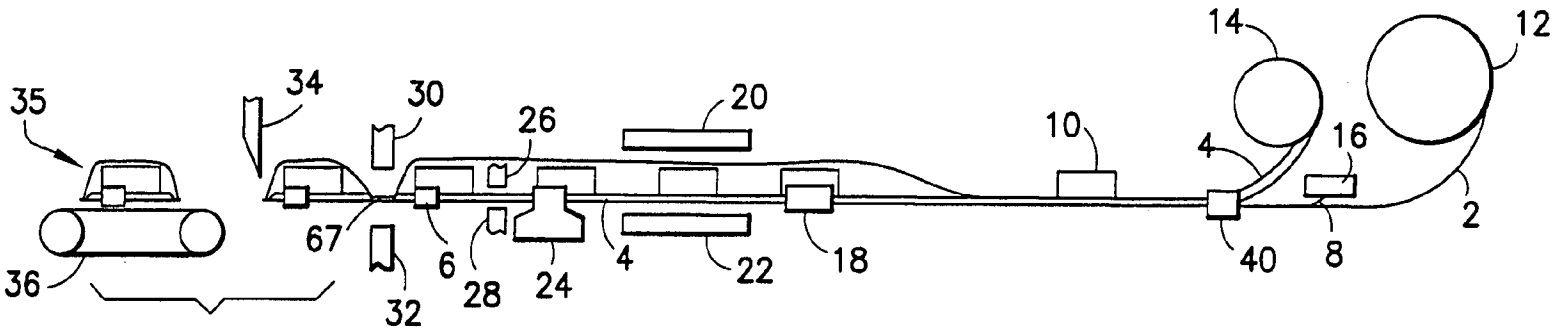
FIGS. 2 and 3 are drawings showing side and top views of portions of an HFFS machine in accordance with one embodiment of the invention. The fold-forming member and folding guide are not shown.
Figure 3:
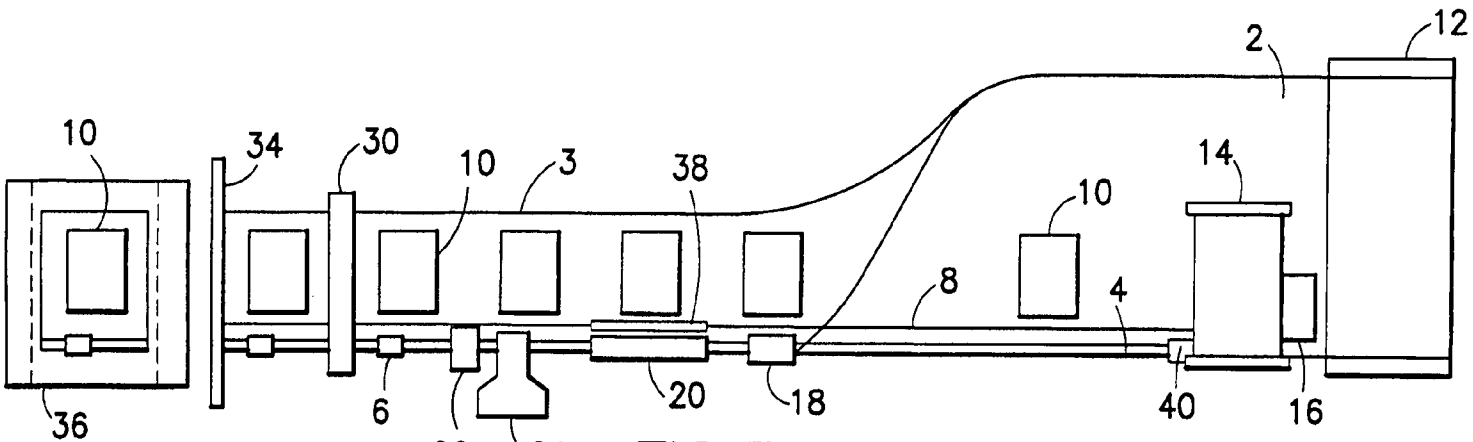

FIGS. 2 and 3 show portions of an HFFS machine in accordance with one embodiment of the invention. A web 2 of film is unwound from a supply roll 12 and then pulled leftward by means of conventional guide and drive rollers (not shown). A string zipper 4, comprising a pair of interlocked flangeless zipper strips, is unwound from a supply reel 14 and guided by a zipper guide 40 to a position overlying a marginal portion of the film web 2. As seen in FIG. 3, the string zipper 4 is placed proximal to and parallel to one edge of the film web 2. In addition, a product loading mechanism (not shown) places a mass of product 10 on top of the portion of the film web 2 that will not be folded over. A respective product mass is placed on the web at the same loading point after each package-length advancement of the web.

Optionally, during each intermittent advance of the web 2, molten peel seal material 8 is applied to the unfolded web 2 by a peel seal applicator 16. In that event, the resulting line of peel seal material 8 runs parallel to the string zipper 4. The peel seal material will be activated later to form an internal hermetic seal on the product side of the zipper.

During each intermittent advance of the web 2, the web is folded over at a location downstream of the product loading point. After folding, the folded-over portion of the film web 2 overlies the product 10 and the zipper 4, with the edges of the folded web generally mutually aligned with each other. Thus, the string zipper 4 is sandwiched between the opposing legs of the folded web 2 as seen in FIG. 4 or 5.

Figure 4:
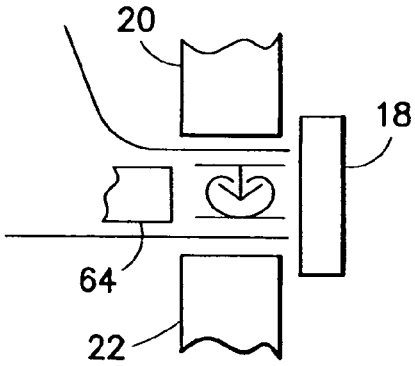
FIG. 4 is a drawing showing means for aligning the zipper and film edges, which means are incorporated in the embodiment depicted in FIGS. 2 and 3.
Figure 5:
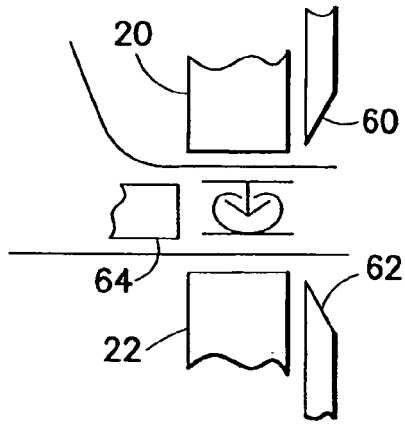
FIG. 5 is a drawing showing means for guiding the zipper and means for aligning and trimming the film edges, which means can be incorporated in a variation of the embodiment depicted in FIGS. 2 and 3.

In accordance with the embodiment depicted in FIG. 4, the opposing edges of the folded web 2 are substantially aligned with the top of the string zipper by aligning means 18, such as photo cells as described hereafter. A zipper guide 64 guides the adjacent section of zipper into proper position relative to the aligning means 18. [The structure of the web edge aligning means in accordance with one embodiment is described in detail later with reference to FIG. 9.]

Next, at a zipper sealing station, these marginal portions of the folded web are joined to the backs of the zipper strips by a pair of mutually opposing conventional heated sealing bars 20 and 22, best seen in FIG. 2. The zipper sealing station is conventional apparatus. The respective zipper strips have their backs sealed to the opposing upper marginal portions of the folded web, thereby attaching each successive section of the string zipper to an adjoining section of the web. The sealing is accomplished by electrically heating the sealing bars 20 and 22. If peel seal material has been laid down, then the peel seal material can be activated at this stage as well.

Figure 6:
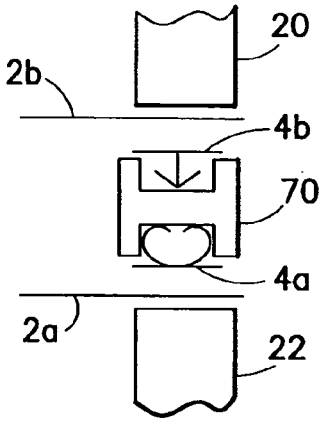
FIG. 6 is a drawing showing a sectional view of a station comprising means for separating the zipper elements and then sealing them to respective film edges, which can be incorporated in a further variation of the embodiment depicted in FIGS. 2 and 3.

In accordance with a further variation depicted in FIG. 6, the zipper halves in each section of zipper to be sealed to the web are separated by a stationary separator plate 70 to prevent seal-through of the zipper halves. The separator plate 70 may be provided with respective grooves for guiding the zipper halves during zipper advancement.

Optionally, zipper sealing may be performed while the zipper and web are moving. In that case, the heat from the sealing bars 20 and 22 is conducted through respective endless barrier strips (not shown) made of Teflon or similar material, which circulate on respective sets of rollers (not shown). Each Teflon barrier strips passes between a respective side of the folded web and a respective sealing bar In the gaps between the opposing sealing bars, the web and string zipper being sandwiched between and held together by the Teflon barrier strips, that move with the web and zipper and prevent the bag making film from sticking against the stationary heated sealing bars during conduction heat sealing. The Teflon barrier strips and intervening web and zipper pass through the nips of a series of guide rollers (not shown). The continuous movement in the zipper sealing station section will be converted to intermittent movement in subsequent stations by a conventional dancer assembly (not shown). In the intermittent advancement phase, the zipper-film assembly is moved one package increment and then stopped for a period of time, i.e., the dwell time, during which time the slider is mounted on the zipper. This cycle is repeated.

In accordance with a variation of the above-described embodiment, the web edges are not aligned with the zipper before zipper sealing. Instead opposing portions of the web are sealed to the backs of the zipper strips and then the marginal portions of the web that extend beyond the string zipper 4 are trimmed to remove excess material after zipper sealing. The trimming operation is depicted in FIG. 5. A zipper guide 64 guides the adjacent section of zipper into proper position relative to a pair of mutually confronting knives 60 and 62. The opposing marginal portions of the web that extend beyond the string zipper 4 are trimmed by these knives. Trimming removes excess film that could interfere with smooth travel of the slider along the zipper. The tips of the knives are placed as close to the zipper as possible to minimize the length of the tails that remain after trimming. Optionally, any free ends or tails at the cut edges of the web can be sealed to the zipper strips in a further separate operation, as disclosed in U.S. patent application Ser. No. 10/655,991, entitled "Method and Apparatus for Making Reclosable Bags Having Slider-Actuated String Zippers".

Although less desirable, one edge of the film web may be aligned while the other web edge is trimmed.

Figure 7:
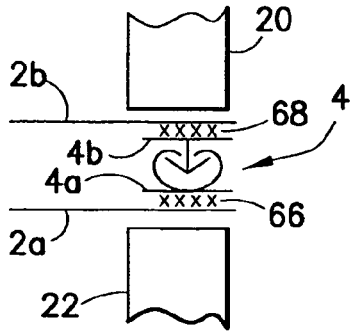
FIG. 7 is a drawing showing a sectional view of a portion of the zipper-web assembly immediately following the zipper sealing operation.

In either case, whether the web edges are aligned or trimmed, the result of the zipper sealing and edge aligning/trimming operations is seen in FIG. 7. A marginal portion of one leg 2*a* of the folded web is joined to the back of the zipper strip 4*a* by means of a heat seal 66, while a marginal portion of the other leg 2*b* of the folded web is joined to the back of the zipper strip 4*b* by means of a heat seal 68.

At the next station of the embodiment depicted in FIGS. 2 and 3, successive sliders 6 are inserted onto the zipper-film assembly, the end result being seen in FIG. 1. If a plow-type slider is being inserted, the slider insertion device 24 (shown in FIGS. 2 and 3) may comprise three assemblies (namely, a separator assembly, a pusher assembly and a clamping assembly) that cooperate to insert the slider on the zipper while the zipper is being held open on one side of the slider insertion zone and clamped closed on the other side of the slider insertion zone. Such a device is fully disclosed in U.S. patent application Ser. No. 10/622,996 entitled "Method and Apparatus for Inserting Sliders During Automated Manufacture of Reclosable Bags". Each slider is inserted onto the string zipper after a respective intermittent advance of the zipper/web assembly.

Figure 8:
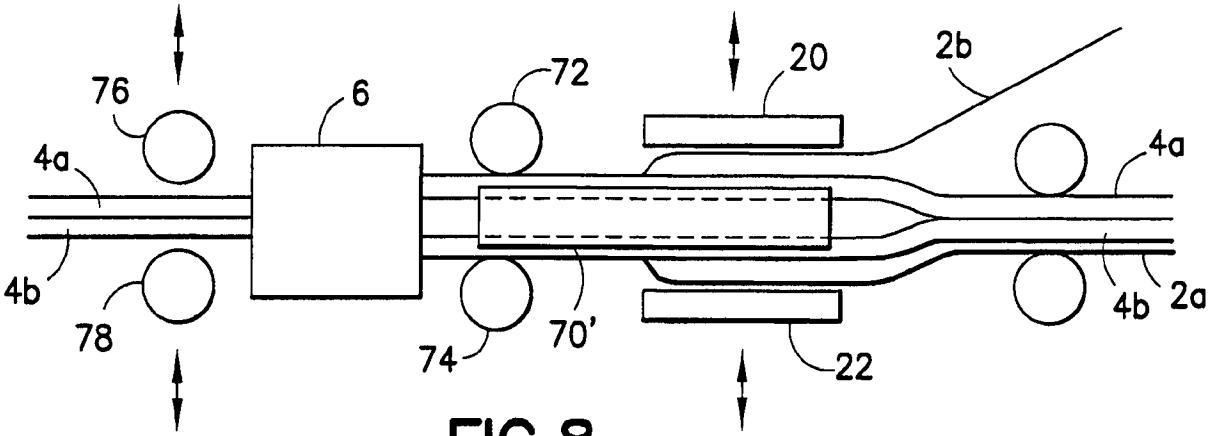
FIG. 8 is a drawing showing an elevational view of portions of another embodiment of the invention.

In accordance with a further variation, a single extended separator plate 70' may be used both to prevent zipper seal-through during sealing of the zipper to the web and to hold the zipper open on one side of the slider insertion zone, as depicted in FIG. 8. FIG. 8 shows the heated sealing bars 20 and 22 in their respective extended positions prior to the sealing operation. FIG. 8 also shows a slider 6 that has been inserted while the zipper halves 4*a* and 4*b* are held in a disengaged state, zipper half 4*a* being held against one side of the separator plate 70' by one guide roller 72 and zipper half 4*b* being held against the other side of the separator plate 70' by another guide roller 74. Downstream of the separator plate, the disengaged zipper halves are squeezed closed by a pair of retractable rollers 76 and 78 before each slider insertion. The rollers retract to allow the slider to pass through when the assembly is advanced after each slider insertion.

During the same dwell time that a slider is being inserted, a slider end stop structure (not shown in FIG. 22) is being formed on the zipper at an ultrasonic stomping station downstream from the slider insertion device. In FIG. 2, the ultrasonic stomping station is generally represented as a horn 26 and an anvil 28. This slider end stop structure will be bisected later during cuffing by a hot knife 34 to form two slider end stops, i.e., the end stop at the zipper fully closed slider park position for one package and the end stop at the zipper fully open slider park position for the next package. The horn 26 transmits sufficient ultrasound wave energy into the plastic zipper material that the plastic is fused into a slider end stop structure (e.g., a vertically extending hump) defined by the surfaces of the horn and anvil.

During each dwell time, a pair of retractable sealing bars 30 and 32 (one or both of which are heated) form cross seals having centerlines spaced at intervals equal to one package length. Thereafter, the hot cutting knife 34 (which may comprise a solitary blade or a pair of opposed blades) cuts the cross-sealed zones, thereby severing a package 35 from the remainder of the zipper-web assembly on the FFS machine. The finished package 35 lands on a take-off belt 36, which conveys the package to a collection area. Alternatively, a separate cross sealing operation is not performed and instead, the hot knife cuts and forms side seals in the film on both sides of the cut in one operation. However, the packages could be left linked together in a package chain instead of being separated.

The extension and retraction of the pusher of the slider insertion device and various other retractable components described above are achieved in the disclosed embodiment by means of respective air cylinders (not shown). Operation of the cylinders is controlled by a programmable controller (not shown), which selectively activates the supply of fluid to the cylinders in accordance with an algorithm or logical sequence. The controller may also take the form of a computer or a processor having associated memory that stores a computer program for operating the machine.

A person skilled in the art of machinery design will readily appreciate that displacing means other than cylinders can be used to displace the separator plate, the clamps, the pusher and the slider stopper. Any other known mechanical displacement means can be used. For the sake of illustration, such mechanical displacement devices include rack and pinion arrangements, rotation of the pinion being driven by an electric motor, and linear actuator comprising a ball screw.

Figure 9:
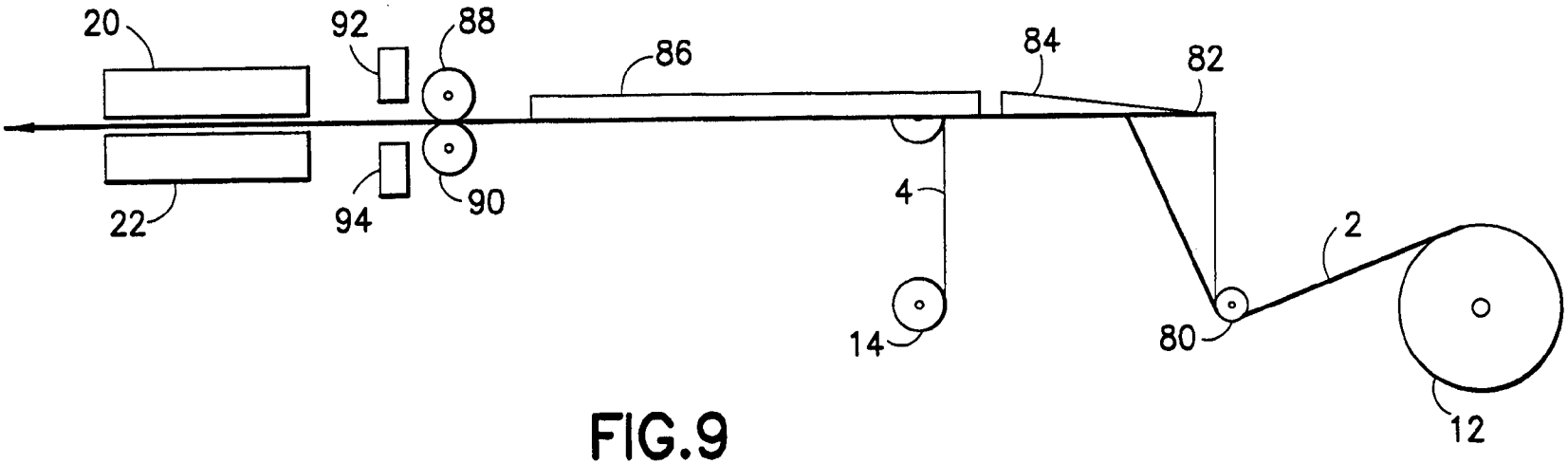
FIG. 9 is a drawing showing folding, aligning and sealing means that can be incorporated in the HFFS machine shown in FIG. 2.

A system for aligning the lateral edges of the packaging film with the zipper may comprise edge sensing and control devices of the type disclosed in U.S. Pat. No. 6,138,436. One such system is generally depicted in FIG. 9. A continuous web 12 of packaging film is dispensed from a supply roll 14 downward under a guide roll 80 and upward toward a fold-forming member 82. The fold-forming member 82 includes a first fold-forming edge that is in a direction transverse to the running direction of the web 12 and a second fold-forming edge that makes an oblique angle with respect to the direction of the first fold-forming edge. The apex formed where the first fold-forming edge meets the second fold-forming edge generally coincides with the center of the web 12, which is continuously folded lengthwise down the middle by the HFFS machine. Passage of the web 12 over the apex begins the folding process.

Disposed on the fold-forming member 80 in a direction perpendicular thereto is a wedge-shaped member 84. The wedge-shaped member 84 essentially raises the web portion being folded over upward relative to the web portion lying flat on the HFFS machine. This is done so that a consumer product to be packaged may be placed on the flat web portion on or near the fold-forming member 82, and eventually be covered by the web portion being folded over.

A folding guide 86 is disposed downstream from the fold-forming member 82 and at an oblique angle relative to the running direction of the film web 12. The folding guide 86 continuously guides one web portion over the other web portion so that, ultimately, the two lateral edges of the web 12 are aligned with one another, and the web may be C-folded continuously in a lengthwise direction. A continuous length of zipper 4 is unwound from a supply reel 14 and guided between the two overlapped lateral edges of the web 12.

Two edge sensing and control devices are situated downstream from the point where the two lateral edges of the web first overlap one another. In a preferred embodiment, each edge sensing and control device comprises a respective photo cell (92 or 94) and a respective steerable guide wheel (88 or 90), one edge sensing and control device being provided for each of the two lateral edges of the web. The photo cells 92, 94 accurately sense the locations of the respective lateral edges and, if the location of either edge deviates from the desired location, signal their respective steerable guide wheels 88, 90 to displace the web until the edge reaches the correct location. More specifically, each steerable guide wheel rotates about a horizontal axis as the web 12 advances on the HFFS machine. When either photo cell senses a deviation in the location of a web edge, a cylinder is actuated to turn the wheel about a vertical axis to displace the edge laterally into the correct position.

Downstream from the two edge sensing and control devices are an upper sealing bar 20 and a lower sealing bar 22 of a type previously described. A suitable stationary device may also be provided for accurately guiding and positioning the zipper 4 between the upper and lower sealing bars. Finally, further downstream from the zipper sealing station, conventional upper and lower cross seal and cut-off jaws can be provided for separating each package from its successor in conventional manner. Thereafter a slider is mounted over the zipper and film attached thereto.

Figure 10:
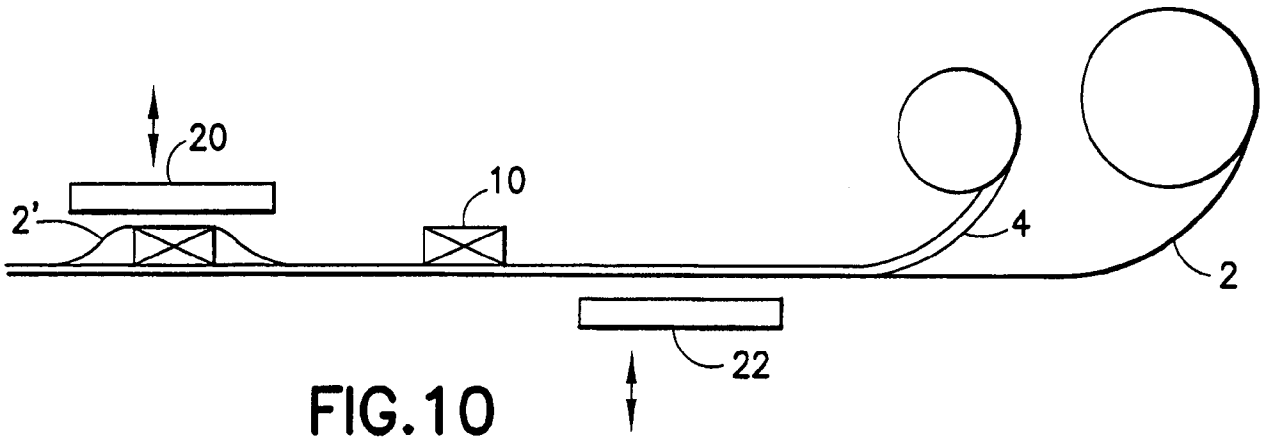
FIG. 10 is a drawing showing a side view of portions of an HFFS machine in accordance with another embodiment of the invention. The fold-forming member and folding guide are not shown.

In accordance with yet another embodiment, partially shown in FIG. 10, the web 2 is unwound from a supply reel and then zipper is unwound and laid along the edge of the unfolded web. The web is then joined to the lower half of the zipper by means of a heated sealing bar 22 at a first sealing station. Then the product 10 is loaded and a portion of the web is folded over the product with the edge of the folded-over portion generally aligned with the other edge of the web. The folded-over portion of the web is then joined to the upper half of the zipper by means of a heated sealing bar 20 at a second sealing station. If the film is advanced intermittently through the sealing stations, then the sealing bars 20 and 22 may be made retractable, as indicated by the double-headed arrows in FIG. 10. Thereafter a slider is mounted over the zipper and film attached thereto.

Figure 11:
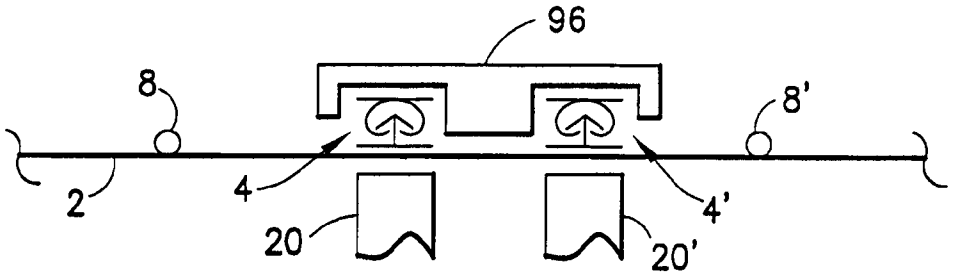
FIGS. 11 through 15 are drawings showing respective stages in a method for dual manufacture of reclosable packages having slider-actuated string zippers in accordance with yet another embodiment of the invention.
Figure 12:
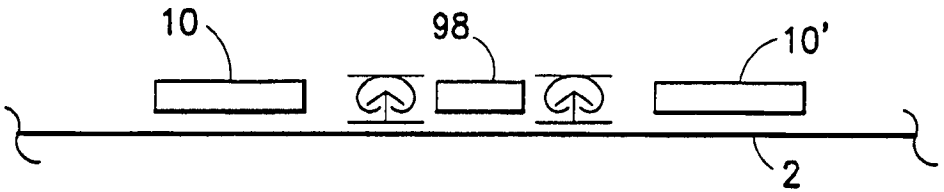

Various stages of a method for dual manufacture of reclosable packages having slider-actuated string zippers in accordance with yet another embodiment of the invention are shown in FIGS. 11 through 15. As seen in FIG. 11, a pair of string zippers 4 and 4' are laid in parallel over a central region of a web 2 of packaging film generally disposed in a horizontal plane. The full width of the unfolded web is not shown in FIG. 11 (or FIG. 12) in order to fit the drawing on one page. The zippers 4 and 4' are guided into position by a zipper guide 96 having a respective groove for each zipper. Optionally, two lines of peel seal material 8 and 8' may also be laid on the web 2 in parallel and outside of the zippers for forming internal peel seals in the finished packages. The bases of the bottom halves of the zippers 4 and 4' are then joined to the web 2 by respective heated sealing bars 20 and 20', which extend into the page. After zipper sealing, the web is advanced one package length. A guide 98 maintains the zippers 4 and 4' in the correct position during advancement.

Figure 13:
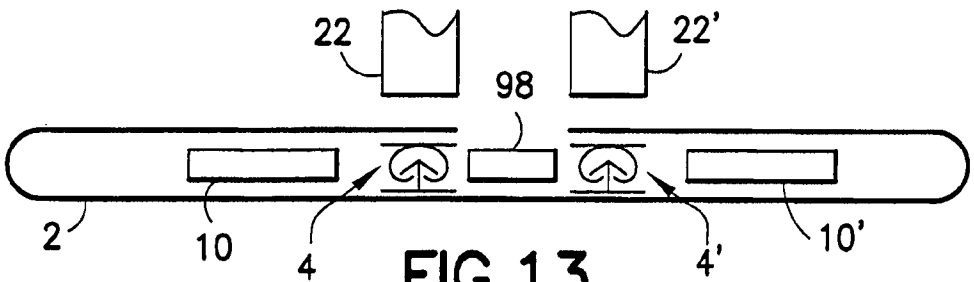

After each advance, two masses of product 10 and 10' are loaded onto the web 2 by conventional means not shown. If peel seal material has been applied, then the product must be placed so that the peel seal material on each side of the web centerline is located between the zipper and product on that side. After product loading, the lateral portions of the web 2 on both sides are folded over respective central portions as seen in FIG. 13, with one edge of the web generally aligned with the top of zipper 4 and the other edge of the web generally aligned with the top of zipper 4'. The means for aligning the web edges with the zippers may be similar to the edge sensing and control devices previously described. After edge alignment, the marginal portions of the web 4 adjacent the edges are joined to the bases of the top halves of the zippers 4 and 4' by respective heated sealing bars 22 and 22'.

Figure 14:
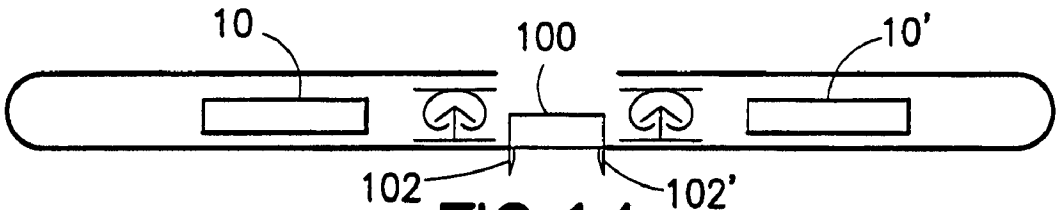
Figure 15:
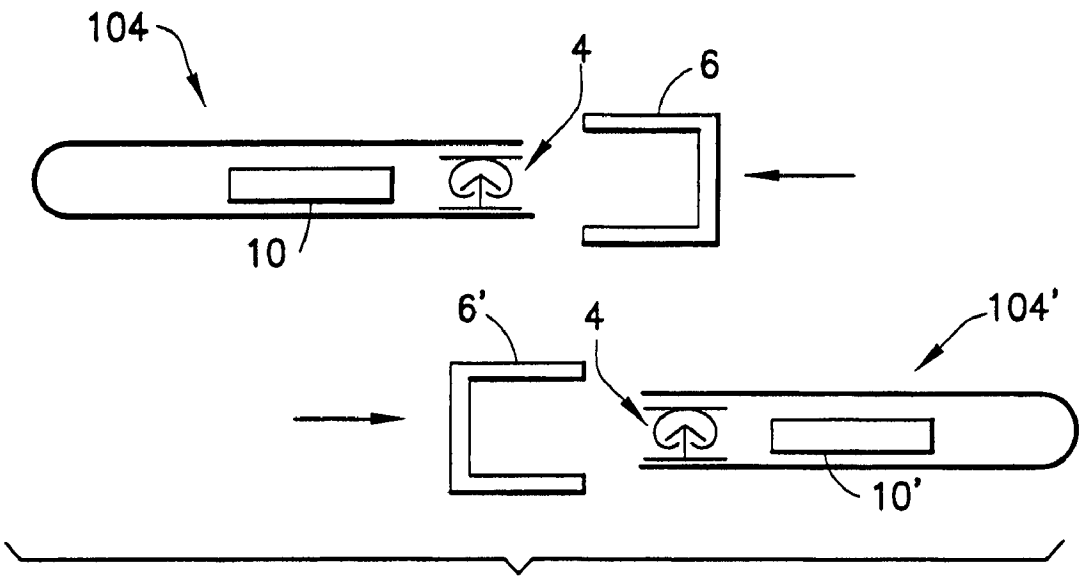

In the next stage of manufacture shown in FIG. 14, the central portion of the web 4 disposed between the zippers 4 and 4' is cut along respective lines that are located as close to the respective zippers as possible. The cuts are made by a cutting device 100 that has a pair of mutually parallel knives 102 and 102'. The result is two severed chains of receptacle precursors (not yet cross sealed and cross cut to form separate packages) 104 and 104' (see FIG. 15), which are vertically offset relative to each other to facilitate slider insertion. Sliders 6 and 6' are inserted onto the respective string zippers 4 and 4' of chains 104 and 104' by conventional slider insertion devices. Thereafter, the respective chains are cross sealed and cross cut at package-length intervals to form respective finished packages in conventional manner. This method has the advantage of forming two bags at a time, thereby doubling productivity.

Figure 24:
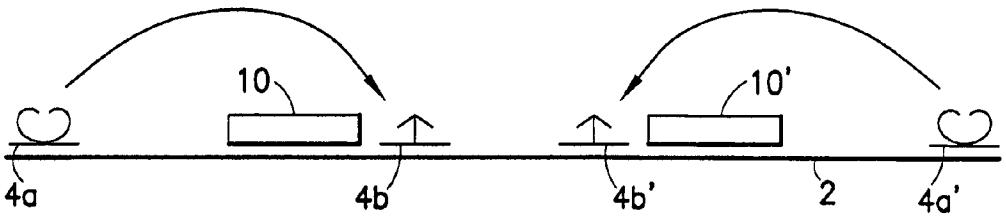
FIG. 24 is a drawing showing a stage in yet another alternative method for the manufacture of reclosable packages having slider-actuated string zippers.

In accordance with one variation of the foregoing method of dual manufacture shown in part in FIG. 24, two zipper halves **4*b* and 4*b*' are joined to a central section of the web while another two zipper halves 4*a* and 4*a*' are joined to marginal portions near the respective edges of the web. Then two masses 10, 10' of product are loaded onto the sections of the web adjacent (and not between) the zipper halves on the central section of the web. After product loading, outer sections of the web are respectively folded over the product masses (as indicated by the curved arrows in FIG. 24). At the same time, the zipper half at one edge of the web is aligned with the central zipper half nearest to the former, while the zipper half at the other edge of the web is similarly aligned with the other central zipper half. The aligned zipper halves have complementary profiles, which are then interlocked to form a pair of closed zippers. The resulting assembly has the same configuration as that seen in FIG. 14**, from which stage the same manufacturing steps can be performed, including trimming the web between the zippers, inserting respective sliders, cross sealing and cross cutting to form two finished packages.

Figure 16:
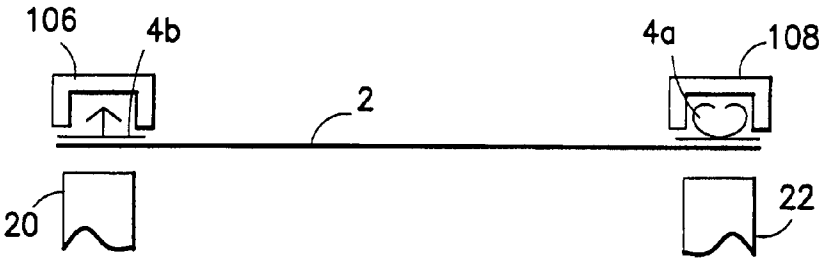
FIGS. 16 through 18 are drawings showing respective stages in an alternative method for the manufacture of reclosable packages having slider-actuated string zippers.
Figure 17:
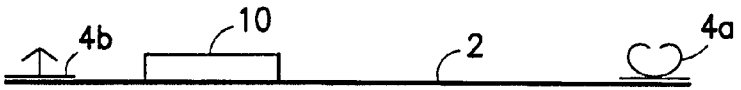
Figure 18:
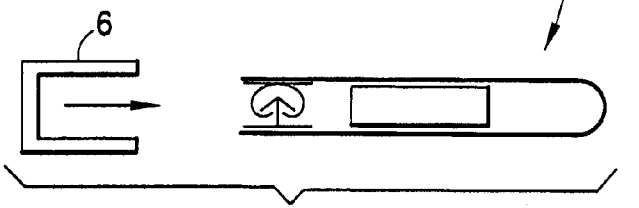

The same principle can be applied when manufacturing reclosable packages singly, as shown in FIGS. 16-18. As seen in FIG. 16, a pair of zipper halves 4*a* and 4*b* with complementary profiles are guided by respective zipper guides 106 and 108 into mutually parallel positions overlying the marginal portions adjacent the respective edges of a web 2 of packaging film. The zipper halves are joined to the respective marginal web portions by means of respective heated sealing bars 20 and 22. In the next stage (depicted in FIG. 17), product is loaded onto the web 2 on one side of a centerline that divides the area between the zipper halves. Then the half of the web 2 on the other side of the centerline is folded over, so that the product is disposed between the two legs of the folded web, and the complementary profiles of the zipper halves 4*a* and 4*b* are aligned and then interlocked to arrive at the assembly 110 depicted on the right-hand side of FIG. 18. A slider 6 is then inserted onto the string zipper in the manner previously described, i.e., by means of a pusher that is displaced by an air cylinder in the direction indicated by the arrow in FIG. 18.

Figure 19:
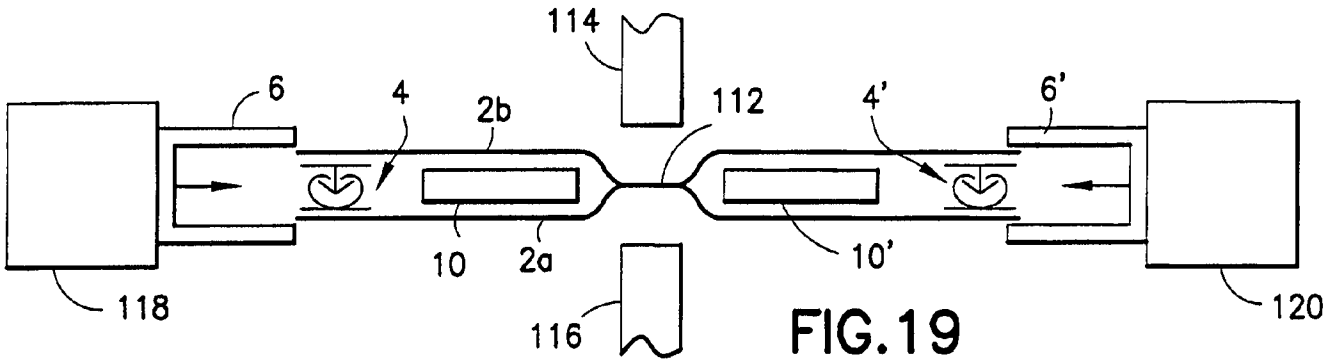
FIG. 19 is a drawing showing a stage in an alternative method for the dual manufacture of reclosable packages having slider-actuated string zippers.

In accordance with alternative embodiments of the invention, instead of folding the web over the product and zipper, two separate sheets can be used. More specifically, product is loaded onto a bottom web, a zipper is joined to a marginal portion of the bottom web, and a top web is laid over the bottom web with the product and zipper therebetween. Then the top sheet is sealed to the zipper and the top and bottom sheets are sealed together along three sides. FIG. 19 shows a stage in the dual manufacture of reclosable packages using two webs 2*a* and 2*b*. Respective zippers 4 and 4' are sealed to respective edges of the webs 2*a* and 2*b*. Respective masses of product 10 and 10' are sandwiched between the webs. Then the webs are sealed together along a central zone 112 by a pair of sealing bars 114 and 116, at least one of which is heated. Also respective sliders 6 and 6' are inserted onto the string zippers 4 and 4' and webs 2*a* and 2*b* respectively sealed thereto by means of respective pushers 118 and 120, which are extended by actuation of respective cylinders in the respective directions indicated by arrows. The edges of the webs 2*a* and 2*b* can be either precisely aligned with the zipper or trimmed as needed to prevent tails or web remnants that might interfere with proper operation of the slider. Thereafter, the webs 2*a* and 2*b* are cross sealed and cross cut (not shown) to form a pair of finished packages loaded with product.

Figure 20:
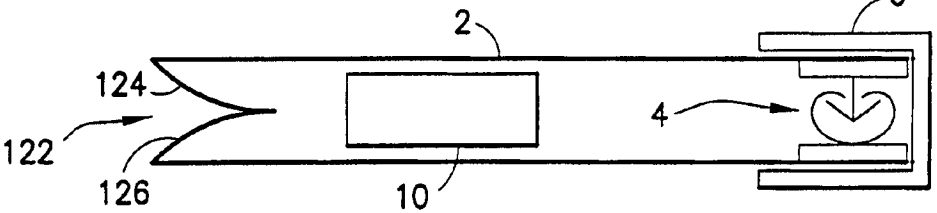
FIG. 20 is a drawing showing a gusseted reclosable package in accordance with a further embodiment of the invention.
Figure 21:
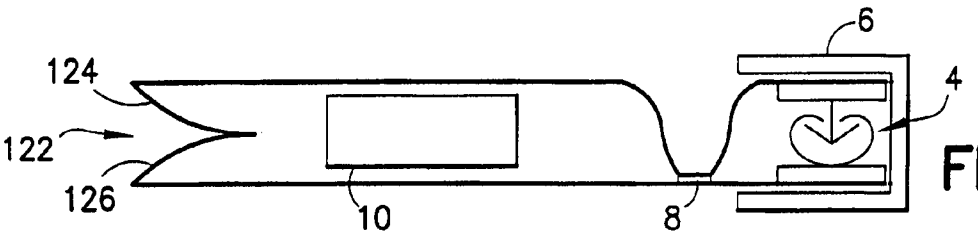
FIG. 21 is a drawing showing the gusseted reclosable package of FIG. 20 with a peel seal added.

In accordance with a further embodiment of the invention shown in FIG. 20, the web 2 can be folded three times along mutually parallel fold lines to form a gusset 122 using well-known gusset-forming means. The gusset 122 will be disposed at the bottom of the finished package and comprises respective gusset panels 124 and 125 connected at a central fold line. In accordance with a further enhancement, the reclosable package may be provided with a peel seal 8 (see FIG. 21) for hermetically sealing the interior volume of the package.

In connection with the various embodiments disclosed above, product loading can be performed in any one of several ways. As described above, product can be loaded before the web of packaging film is folded or between the separated film folds. Alternatively, product can be loaded after folding by slitting the web at the fold line, loading product through the slit and then resealing the opposing film edges at the slit. In accordance with another technique, product can be loaded after folding of the web and after slider insertion. The slider is then used to open and close the zipper, with product being inserted while the zipper is open. Alternatively, if two sheets of packaging film are used, then product can be loaded onto one sheet, the second sheet is then placed over the first sheet with the product therebetween, and then the edges of the sheets are sealed together on three sides to form a receptacle.

Figure 22:
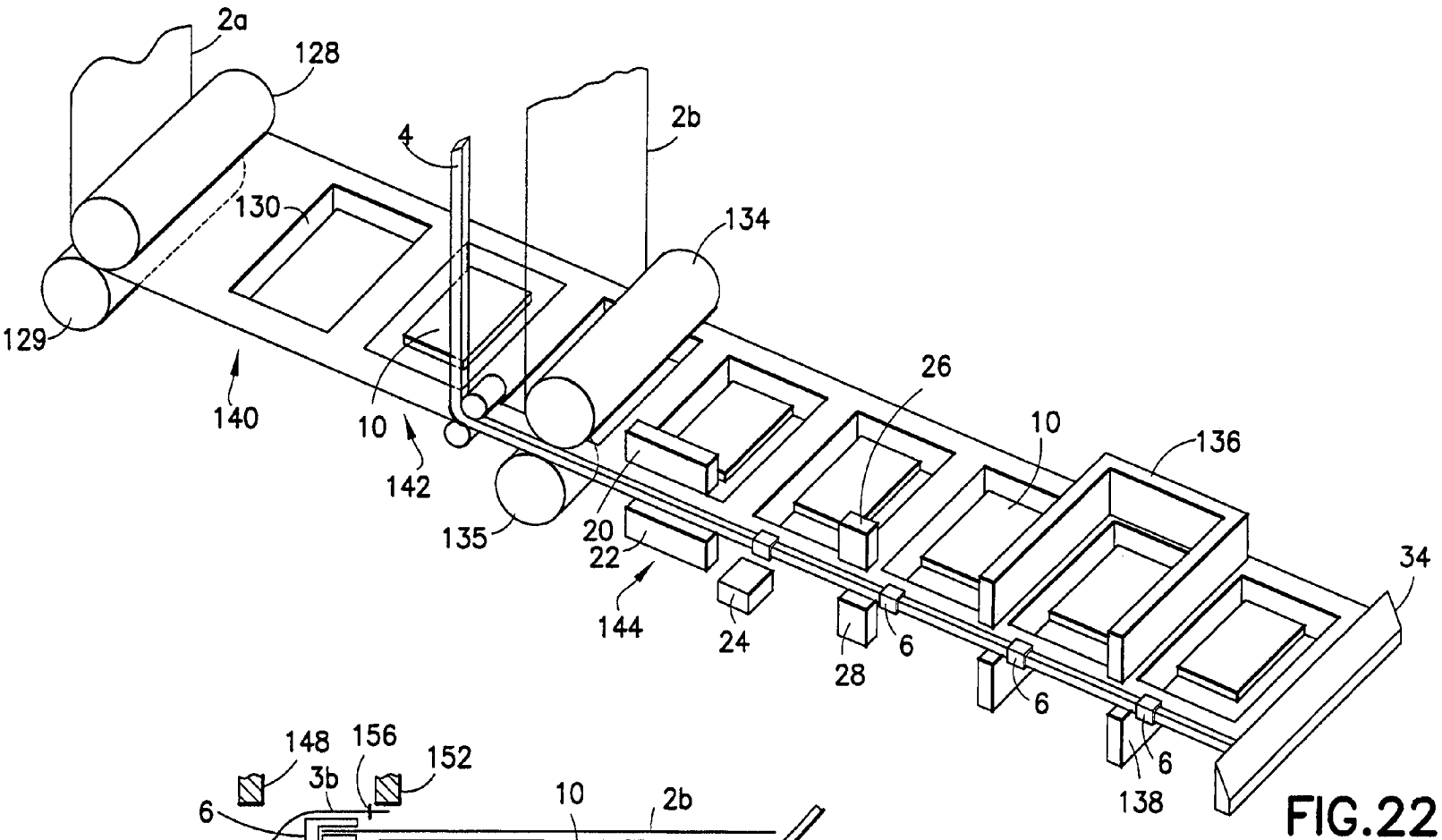
FIG. 22 is a drawing showing an isometric view of an HFFS machine that makes thermoformed packages having slider-actuated string zippers in accordance with yet another embodiment of the invention.

FIG. 22 shows of an HFFS machine that makes thermoformed packages in accordance with yet another embodiment of the invention. The machine comprises a machine frame (not shown) with an inlet side and an outlet side. A bottom web 2*a* of packaging film is unrolled from a supply roll (not shown) located at the inlet side, pulled through pinch rollers 128 and 129, and passed to the outlet side through the various working stations. The bottom web 2*a* is first fed to a thermoforming station 140, where successive trough-shaped trays or pockets 130 for receiving product are formed during each dwell time by deep-drawing using vacuum and heat. The thermoforming means typically comprise opposing retractable evacuable heated dies (not shown). At a station 142 downstream of the thermoforming station, product 10 is loaded into each tray.

In addition, a continuous strand of string zipper 4 is unwound from a supply reel (not shown) and pulled through a pair of pinch rollers. The zipper 4 is deposited onto an unthermoformed marginal portion of the bottom web 2*a* that is disposed between the thermoformed pockets 130 and one edge of the web. Immediately after the zipper is laid down, a top web 2*b* is unrolled from a supply roll (not shown) and pulled through a long pinch roller 134 and an opposing pair of short pinch rollers 135 (only one of which is shown in FIG. 22). The top web 2*b* is deposited on top of the bottom web 2*a* and the zipper 4. The top and bottom webs, with the zipper material sandwiched therebetween, are then advanced to a sealing station 144 and halted. The sealing stations typically comprises a pair of retractable heated sealing bars 20 and 22. The respective sections of the top and bottom webs disposed within the sealing station are then sealed to the opposing sides of the zipper bases while the webs and zipper are stationary. The sealed section is thereafter advanced one package length and a slider 6 is inserted onto the string zipper, the zones of joinder of the top and bottom webs with the zipper being disposed between the sides of the zipper and the sidewalls of the slider. During the same dwell time, a slider end stop structure (not shown) is formed on the string zipper by ultrasonic stomping using an ultrasonic welding assembly comprising a horn 26 and an anvil 28. In the next stage, the top web 2*b* is sealed to the bottom web along three sides by a pair of U-shaped sealing bars 136 and 138, at least one of which is heated. Alternatively, the cross seals and the bottom seals (those opposite the zipper location) may be made at separate stations. This forms a receptacle loaded with product. A finished package is then formed by cuffing the top and bottom webs along a transverse line that generally bisects the cross seal (of the three-sided seal) furthest downstream. FIG. 22 shows a retractable knife 34 for making this cross cut. Alternatively, a pair of mutually opposing retractable knives can be used. The operations of the various activatable packaging machine components depicted in FIG. 22 may be controlled by a conventional programmed logic controller (PLC) in well-known manner. As can be well understood, this embodiment can be doubled as depicted in FIG. 19.

Figure 23:
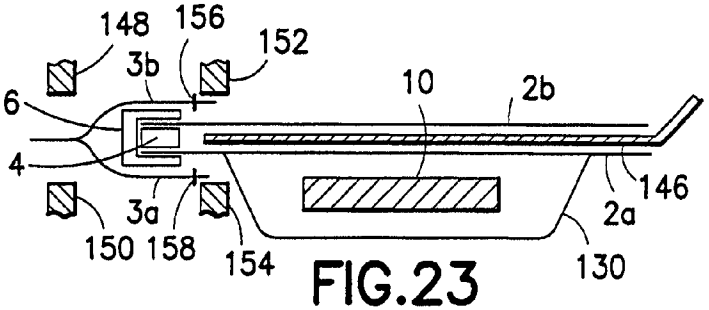
FIG. 23 is a drawing showing the attachment of a header in accordance with an optional feature of the embodiment depicted in FIG. 22.

Optionally, a header may be placed on each package to provide a tamper-evident feature. The operations for accomplishing this, which are preferably performed before the top and bottom webs are sealed together along three sides, are generally depicted in FIG. 23. A separating plate 146 is inserted between the top and bottom webs 4*a* and 4*b* to prevent seal-through of those webs in the band-shaped zone where the header will be joined to the webs. As seen in FIG. 23, top and bottom header strips are unwound from respective supply rolls (not shown) and fed around respective deflection rollers (not shown) for placing the bottom header strip 3*a* under the slider-zipper assembly and placing the top header strip 3*b* over the slider zipper assembly. A pair of sealing bars 148 and 150, at least one of which is heated, join marginal portions of the header strips together at the top of the package. However, the header strip may also be provided in a folded U-shaped configuration, thereby eliminating the requirement of the header strips being sealed together. During the same dwell time, a heated sealing bar 152 joins the other marginal portion of the top header strip 3*b* to the top web 2*b* along a band-shaped zone having a length generally equal to one package length, while a heated sealing bar 154 joins the other marginal portion of the bottom header strip 3*a* to the bottom web 2*a* along a band-shaped zone having a length generally equal to one package length. These heat seals are formed on the package at an elevation below the string zipper 4. In this embodiment, the legs of the U-shaped sealing bars (136 and 138 in FIG. 22) must be extended to form side seals on the header in alignment with the side seals being formed on the receptacle. The respective header strips 3*a* and 3*b* may be provided with respective lines 156 and 158 of weakened tear resistance (e.g., lines of spaced perforations or scorelines) to facilitate tearing off of the header by a consumer. The tear lines should be placed to expose the slider when the header is removed. The header strips may also be provided with punched out windows indexed to overlie the positions of the sliders.

In the various embodiments described above, sealing is accomplished using sealing bars. Alternatively, sealing could be accomplished using a sealing wheel or a drag seal. In such an instance, part of the operation would be continuous and another part intermittent, with a series of dancer bars converting one to the other.

Furthermore, there are two types of sliders that can be used in the form-fill-seal processes disclosed herein. In one type of slider-operated zipper assembly, the slider straddles the zipper and has a separating finger at one end that is inserted between the profiles to force them apart as the slider is moved along the zipper in an opening direction. The other end of the slider is sufficiently narrow to force the profiles into engagement and close the zipper when the slider is moved along the zipper in a closing direction. Other types of slider-operated zipper assemblies avoid the use of a separating finger. For example, U.S. Pat. No. 6,047,450 discloses a zipper comprising a pair of mutually interlockable profiled closure members, portions of which form a fulcrum about which the profiled closure members may be pivoted out of engagement when lower edges of the bases are forced towards each other.

While the invention has been described with reference to preferred embodiments, it will be understood by those skilled in the art that various changes may be made and equivalents may be substituted for members thereof without departing from the scope of the invention. In addition, many modifications may be made to adapt a particular situation to the teachings of the invention without departing from the essential scope thereof. Therefore it is intended that the invention not be limited to the particular embodiment disclosed as the best mode contemplated for carrying out this invention, but that the invention will include all embodiments falling within the scope of the appended claims.

As used in the claims, the verb "joined" means fused, bonded, sealed, adhered, etc., whether by application of heat and/or pressure, application of ultrasonic energy, application of a layer of adhesive material or bonding agent, interposition of an adhesive or bonding strip, etc. As used in the claims, the term "string zipper" means a zipper comprising two interlockable strips that have substantially no flange or fin portions. As used in the claims, the phrase "inserting sliders" should be construed in a manner that it reads on inserting sliders with plows onto partially open zipper strips and also reads on inserting sliders without plows onto closed or partially open zipper strips.

The invention claimed is:

1. A method of making reclosable packages, comprising the following steps:

(a) providing a continuous elongated web of packaging film having first and second edges that are generally mutually parallel when said web lies in a horizontal plane;

(b) placing products to be packaged at spaced intervals on a longitudinal portion of said web that extends in a direction of web elongation, said web portion being closer to said first edge than to said second edge of said web;

(c) folding said web along a line that is generally parallel to said first edge of said web to form a first folded side and a second folded side interconnected by a folded section, said products being disposed between said first and second folded sides;

(d) joining a back of a continuous length of a first flangeless zipper strip to said web along a first longitudinal zone of said web;

(e) joining a back of a continuous length of a second flangeless zipper strip to said web along a second longitudinal zone of said web;

(f) aligning said first flangeless zipper strip with said second flangeless zipper strip;

(g) inserting sliders at spaced intervals along said aligned first and second flangeless zipper strips, said first and second longitudinal zones of said web passing between respective side walls of said slider and said respective backs of said first and second flangeless zipper strips; and (h) sealing said folded web crosswise at regular intervals located between said products.

2. The method as recited in claim 1, further comprising the following step:

(i) severing individual packages by cutting said folded web and said first and second flangeless zipper strips at regular intervals, wherein the cut lines generally intersect the respective crosswise seals formed in step (h).

3. The method as recited in claim 2, wherein steps (h) and (i) are performed concurrently by a hot knife.

4. The method as recited in claim 1, wherein step (c) is performed before steps (d) and (e).

5. The method as recited in claim 1, wherein step (c) is performed after steps (d) and (e).

6. The method as recited in claim 1, wherein step (c) is performed after step (d) and before step (e).

7. The method as recited in claim 1, wherein step (f) is performed after step (c).

8. The method as recited in claim 1, further comprising the steps of advancing said web and detecting the lateral position of said first edge of said web at a first location during advancement of said web, said first location being upstream of a location where said first flangeless zipper strip is joined to said web.

9. The method as recited in claim 8, further comprising the step of adjusting the position of said first edge at a second location upstream of said first location during advancement of said web, said adjusting step being a function of results of said detecting step.

10. The method as recited in claim 1, further comprising the step of trimming said first edge of said web after said web is joined to said first flangeless zipper strip.

* * * * *